US008184088B2

(12) United States Patent
Nonaka et al.

(10) Patent No.: US 8,184,088 B2
(45) Date of Patent: May 22, 2012

(54) IMAGE DISPLAY APPARATUS AND IMAGE DISPLAY METHOD

(75) Inventors: Ryosuke Nonaka, Kawasaki (JP); Masahiro Baba, Yokohama (JP); Goh Itoh, Tokyo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 762 days.

(21) Appl. No.: 12/326,338

(22) Filed: Dec. 2, 2008

(65) Prior Publication Data

US 2009/0140975 A1 Jun. 4, 2009

(30) Foreign Application Priority Data

Dec. 4, 2007 (JP) ..... 2007-313485

(51) Int. Cl.
*G09G 3/36* (2006.01)

(52) U.S. Cl. ..... 345/102; 345/103; 345/104; 345/690; 345/693; 345/698

(58) Field of Classification Search ..... None
See application file for complete search history.

(56) References Cited

U.S. PATENT DOCUMENTS

| | | | | |
|---|---|---|---|---|
| 7,469,072 | B2 * | 12/2008 | Yano | 382/274 |
| 7,580,024 | B2 * | 8/2009 | Kamimura | 345/102 |
| 7,609,244 | B2 * | 10/2009 | Kim et al. | 345/89 |
| 7,893,917 | B2 * | 2/2011 | Baba et al. | 345/102 |
| 7,948,563 | B2 * | 5/2011 | Sono | 348/687 |
| 8,031,166 | B2 * | 10/2011 | Qiao et al. | 345/102 |
| 8,044,983 | B2 * | 10/2011 | Nonaka et al. | 345/690 |
| 2005/0184952 | A1 * | 8/2005 | Konno et al. | 345/102 |
| 2006/0214904 | A1 * | 9/2006 | Kimura et al. | 345/102 |
| 2007/0070214 | A1 * | 3/2007 | Nakamura | 348/222.1 |
| 2007/0152949 | A1 * | 7/2007 | Sakai | 345/102 |
| 2007/0222740 | A1 * | 9/2007 | Hanada | 345/102 |
| 2008/0084509 | A1 * | 4/2008 | Inoue et al. | 348/744 |
| 2008/0100645 | A1 * | 5/2008 | Nitta | 345/690 |
| 2008/0111784 | A1 * | 5/2008 | Tanaka et al. | 345/102 |
| 2008/0129679 | A1 * | 6/2008 | Yamamoto | 345/102 |

FOREIGN PATENT DOCUMENTS

| | | |
|---|---|---|
| JP | 2005-258403 | 9/2005 |
| JP | 2007-034251 | 2/2007 |
| JP | 2007-322882 | 12/2007 |

OTHER PUBLICATIONS

Nonaka, U.S. Appl. No. 12/332,097, filed Dec. 10, 2008, entitled Liquid Crystal Display Apparatus.
Chen et al.; "Backlight Local Dimming Algorithm for High Contrast LCD-TV"; Proc. of ASID"06, New Delhi, pp. 168-171, (2006).
Chen, H. et al. "Backlight Local Dimming Algorithm for High Contrast LCD-TV," Proc. of ASID '06, pp. 168-171.

* cited by examiner

*Primary Examiner* — Dismery Mercedes
(74) *Attorney, Agent, or Firm* — Finnegan, Henderson, Farabow, Garrett & Dunner, L.L.P.

(57) ABSTRACT

An image display apparatus includes: a luminance modification unit configured to modify the luminance setting value so as to make a luminance difference between adjacent partial regions of a back light smaller; a luminance distribution calculation unit configured to calculate a predicted value of luminance distribution of light incident on a liquid crystal panel from the back light on the basis of the modified luminance setting value; a liquid crystal transmittance correction unit configured to correct an optical transmittance of the image signal at each pixel of the liquid crystal panel on the basis of the image signal and the luminance distribution; a back light control unit configured to control the back light on the basis of the modified luminance setting value; and a liquid crystal control unit configured to control the liquid crystal panel so that the transmittance of the image signal becomes the corrected optical transmittance.

10 Claims, 14 Drawing Sheets

IMAGE DISPLAY APPARATUS AND IMAGE DISPLAY METHOD

CROSS-REFERENCE TO RELATED APPLICATION

This application is based upon and claims the benefit of priority from prior Japanese Patent Application No. 2007-313485 filed on Dec. 4, 2007 in Japan, the entire contents of which are incorporated herein by reference.

BACKGROUND OF THE INVENTION

1. Field of the Invention

The present invention relates to an image display apparatus and an image display method.

2. Related Art

In the conventional liquid crystal display apparatus, back light luminance control is conducted by dividing the screen into a plurality of regions with the object of expanding the display dynamic range and reducing the power dissipation. For example, according to JP-A 2005-258403 (KOKAI), back light luminance is controlled so as to make the back light luminance in each of regions obtained by division equal to at least the maximum display luminance of a video signal in the region.

When it is attempted to display an image expressing a light source in a dark background like, for example, a night view, however, it is necessary to set the back light luminance to a bright value in order to represent the brightness of the light source in a region expressing a bright light source in a dark background. If in this case the back light luminance is made bright, the dark background around the image of the light source is also displayed brightly. This is caused by the fact that it is in principle impossible to make the optical transmittance of liquid crystal small enough to display the dark background. On the other hand, if its peripheral region has only a dark background, then the back light is set to be dark and consequently the dark background is displayed sufficiently darkly. If a region expressing a bright source in a dark background and a region expressing only a dark background are adjacent to each other, the brightness of the displayed background differs between these regions and consequently unevenness occurs between the dark background regions. If the back light luminance difference between adjacent regions is small, it is possible to reduce the unevenness by correcting the optical transmittance of liquid crystal so as to make the optical transmittance of the liquid crystal relatively small in a region where the back light luminance is large and make the optical transmittance of the liquid crystal relatively large in a region where the back light luminance is small. However, since there is a limit in the black display capability of the liquid crystal as described above, it is difficult to remove this unevenness by only correction of the transmittance when the back light luminance difference between the adjacent regions is large.

For example, assume that it is attempted to display an image in which a light source having a relative luminance of 1.0 is expressed on a dark background having a relative luminance distributed in the range of 0.000002 to 0.001 when the minimum transmittance which can be implemented with liquid crystal is 0.002. In this case, since it is necessary that the relative luminance is 1.0 in the region where the light source is expressed, it is desirable to set the relative luminance of the back light equal to 1.0. Therefore, the range of the relative luminance which can be represented in this region is a range of 0.002 to 1.0 obtained by multiplying the relative luminance of the back light by the transmittance of the liquid crystal. On the other hand, in a region where the light source is not expressed, it is desirable to set the relative luminance of the back light equal to 0.001 in order to make it possible to represent the relative luminance 0.000002 to 0.001 sufficiently. Therefore, the range of the relative luminance which can be represented in this region is a range of 0.000002 to 0.001 obtained by multiplying the relative luminance of the back light by the transmittance of the liquid crystal. As a result, a dissimilarity occurs in the range of the relative luminance which can be represented between the two regions. In principle, it is impossible to compensate the luminance difference between the two regions. Therefore, unevenness occurs between the two regions.

SUMMARY OF THE INVENTION

The present invention has been made in view of these circumstances, and an object thereof is to provide an image display apparatus and an image display method capable of suppressing luminance unevenness caused by luminance difference of the back light between adjacent regions.

According to a first aspect of the present invention, there is provided an image display apparatus including: a liquid crystal panel including a plurality of pixels arranged in a matrix form; a back light including a luminous region to supply light to the liquid crystal panel, the luminous region being divided into a plurality of partial regions, light adjustment being possible for each of the partial regions; a luminance calculation unit configured to calculate a luminance setting value of light emitted from each partial region of the back light on the basis of an image signal; a luminance modification unit configured to modify the luminance setting value so as to make a luminance difference between adjacent partial regions of the back light smaller; a luminance distribution calculation unit configured to calculate a predicted value of luminance distribution of light incident on the liquid crystal panel from the back light on the basis of the modified luminance setting value; a liquid crystal transmittance correction unit configured to correct an optical transmittance of the image signal at each pixel of the liquid crystal panel on the basis of the image signal and the luminance distribution; a back light control unit configured to control the back light on the basis of the modified luminance setting value; and a liquid crystal control unit configured to control the liquid crystal panel so that the transmittance of the image signal becomes the corrected optical transmittance.

According to a second aspect of the present invention, there is provided an image display method image display method for an image display apparatus including a liquid crystal panel having a plurality of pixels arranged in a matrix form, and a back light including a luminous region to supply light to the liquid crystal panel, the luminous region being divided into a plurality of partial regions, light adjustment being possible for each of the partial regions, the method including: calculating a luminance setting value of light emitted from each partial region of the back light on the basis of an image signal; modifying the luminance setting value so as to make a luminance difference between adjacent partial regions of the back light small; calculating a predicted value of luminance distribution of light incident on the liquid crystal panel from the back light on the basis of the modified luminance setting value; correcting an optical transmittance of the image signal at each pixel of the liquid crystal panel on the basis of the image signal and the luminance distribution; controlling the back light on the basis of the modified luminance setting value; and controlling the liquid crystal panel so that the transmittance of the image signal becomes the corrected optical transmittance.

DETAILED DESCRIPTION OF THE INVENTION

Hereafter, embodiments of the present invention will be described in detail with reference to the drawings.

First Embodiment

An image display apparatus according to a first embodiment of the present invention will now be described with reference to FIGS. 1 to 12(*b*).

(1) Configuration of Image Display Apparatus

Figure 1:
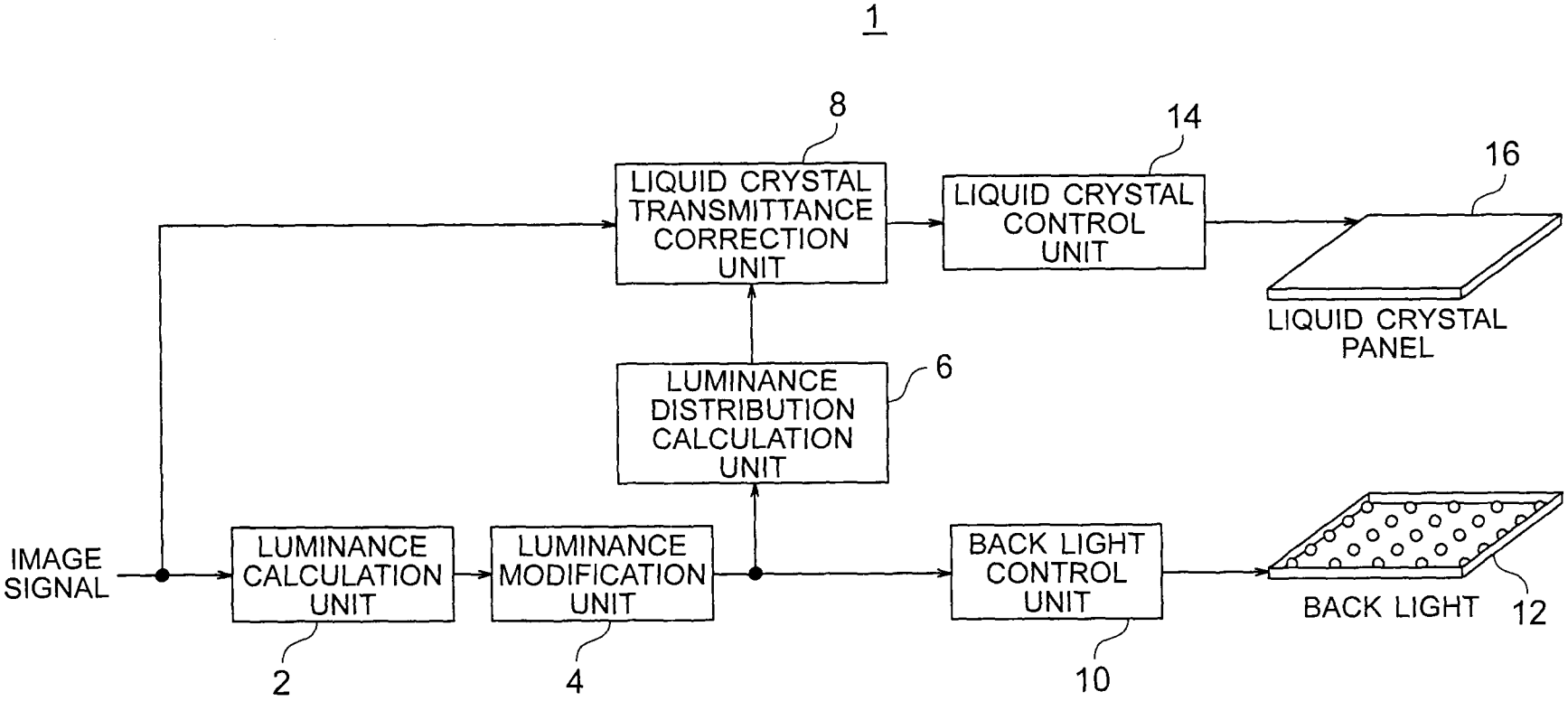
FIG. 1 is a diagram showing an image display apparatus in a first embodiment of the present invention.

A configuration of an image display apparatus according to the present embodiment is shown in FIG. 1. The image display apparatus 1 according to the present embodiment includes a luminance calculation unit 2, a luminance modification unit 4, a luminance distribution calculation unit 6, a transmittance correction unit 8, a back light control unit 10, a back light 12, a liquid crystal control unit 14, and a liquid crystal panel 16 having a plurality of pixels arranged in a matrix form.

The luminance calculation unit 2 calculates a luminance setting value of the back light 12 suitable for display on the basis of an image signal. The luminance modification unit 4 modifies the setting value calculated by the luminance calculation unit 2. The luminance distribution calculation unit 6 calculates a predicted value of luminance distribution of light incident on the liquid crystal panel 16 from the back light 12 when the back light is lit with the modified setting values on the basis of the setting value modified by the luminance modification unit 4. The liquid crystal transmittance correction unit 8 corrects the optical transmittance of an image signal in each pixel of the liquid crystal panel 16 on the basis of the calculated predicted value of the luminance distribution and the image signal, and outputs the image signal corrected in optical transmittance to the liquid crystal control unit 14. The back light control unit 10 lights the back light 12 on the basis of the setting value modified by the luminance modification unit 4. The back light 12 has at least two partial regions, and each partial region is lit under control of the back light control unit 10. The liquid crystal control unit 14 controls the liquid crystal panel 16 on the basis of the image signal corrected in optical transmittance by the liquid crystal transmittance correction unit 8. The liquid crystal panel 16 changes the transmitted light quantity under the control of the liquid crystal control unit 14.

Hereafter, details of configurations and operations of respective units will be described.

Back Light

Figure 2:
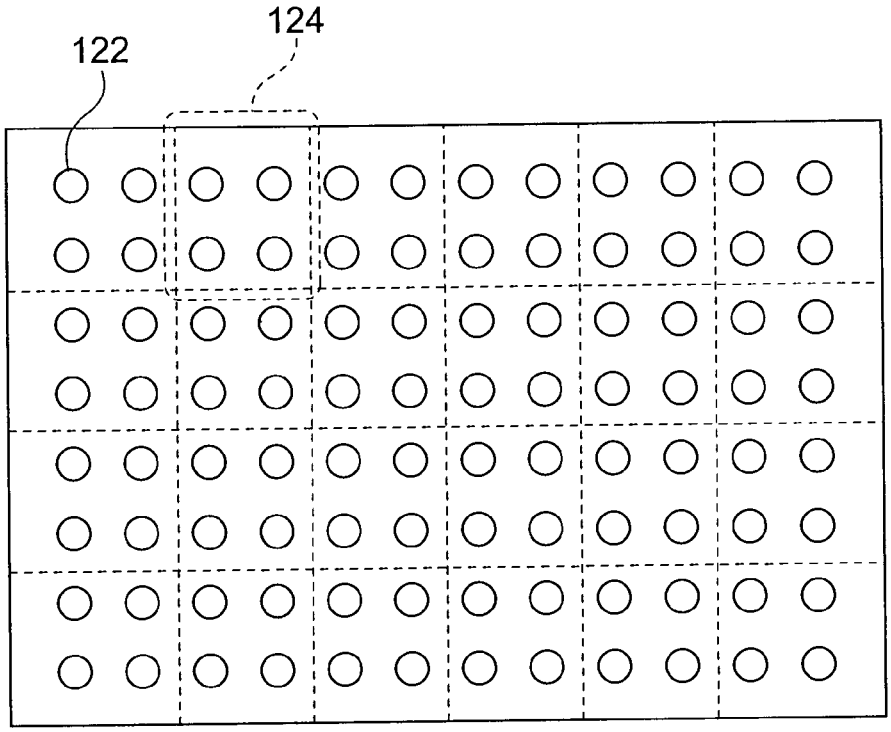
FIG. 2 is a diagram showing a back light in the first embodiment.

The back light 12 includes a luminous region. This luminous region is divided into at least two partial regions. Each partial region is lit strongly or weakly under the control of the back light control unit 10. The liquid crystal panel 16 is irradiated from the back. A configuration of a concrete example of the back light 12 is shown in FIG. 2. As shown in FIG. 2, the back light 12 includes at least one light source 122. The back light 12 is divided into at least one partial region 124 each having at least one light source 122 therein. Respective partial regions 124 can be controlled in light emission strength (light emission luminance) and light emission timing independently by the back light control unit 10. As for the light source 122, an LED, a cold cathode tube, a hot cathode tube, or the like is suitable. In particular, the LED has a wide range between a maximum light emission capable luminance and a minimum light emission capable luminance and is capable of exercising luminous control with a wide dynamic range. Therefore, it is desirable to use the LED as the light source.

Back Light Control Unit

Figure 3:
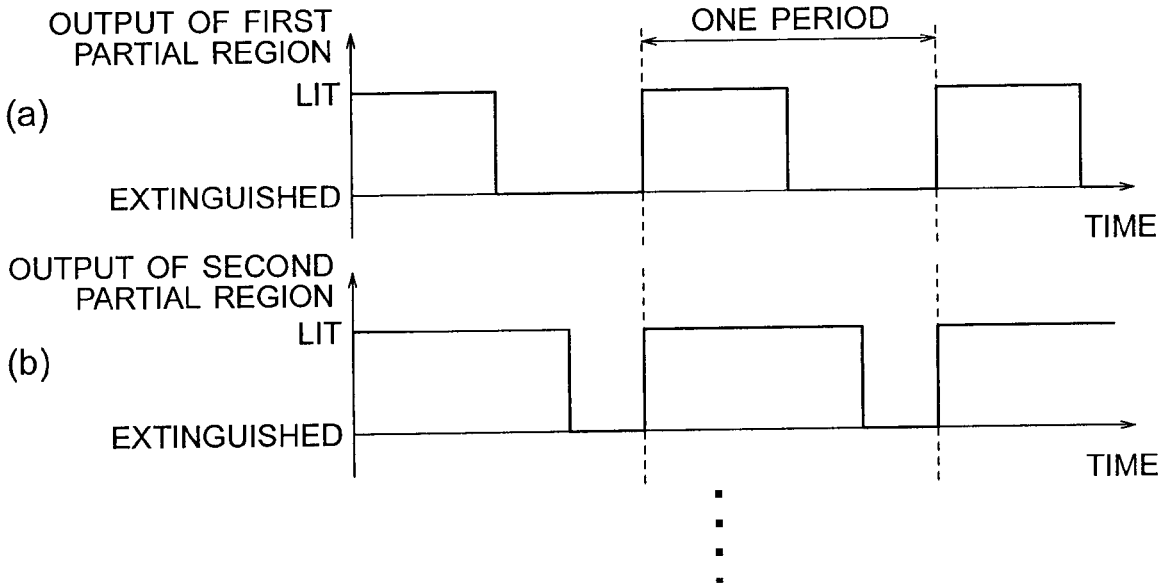
FIGS. 3(*a*) and 3(*b*) are diagrams showing operation of a back light control unit in the first embodiment.

The back light control unit 10 lights the back light 12 on the basis of the luminance setting value of the back light modified by the luminance modification unit 4. An output example of the back light control unit 10 in the case where the back light 12 is controlled by using the PWM (Pulse Width Modulation) system is shown in FIGS. 3(*a*) and 3(*b*). FIG. 3(*a*) shows an output example in the case where a PWM control signal having a relative luminance of 0.5 is output in a first partial region. FIG. 3(*b*) shows an output example in the case where a PWM control signal having a relative luminance of 0.75 is output in a second partial region. In the PWM control system, luminance control of each partial region is exercised by changing the ratio of the lighting time period in one period.

In this way, the back light control unit 10 can control light emission intensity (light emission luminance) and light emission timing of each partial region 124 of the back light 12 independently.

Luminance Calculation Unit

Figure 4:
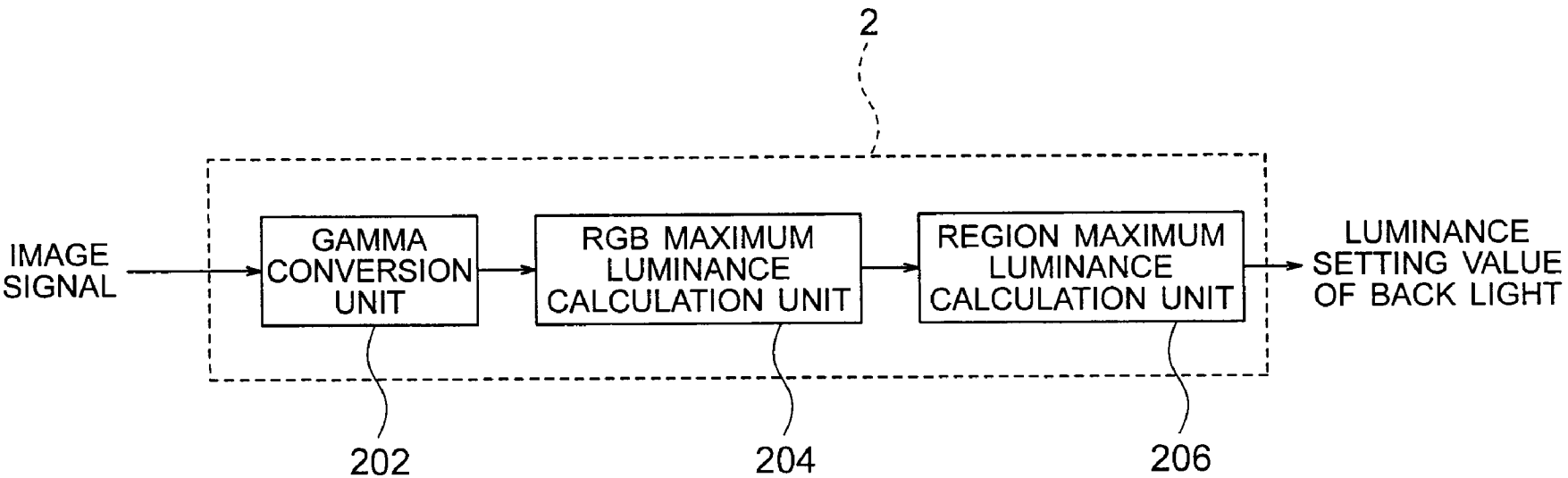
FIG. 4 is a diagram showing a luminance calculation unit in the first embodiment.

The luminance calculation unit 2 calculates a setting value of luminance of the back light 12 suitable for display from an image signal. A configuration of a concrete example of the luminance calculation unit 2 is shown in FIG. 4. The luminance calculation unit 2 in this concrete example includes a gamma conversion unit 202, an RGB maximum luminance calculation unit 204, and a region maximum luminance calculation unit 206.

The gamma conversion unit 202 converts an input image signal to relative luminance $L_R$, $L_G$ and $L_B$ respectively of R (red), G (green) and B (blue) by gamma conversion. Supposing that image signal values are signal values in the range of [0, 255] respectively corresponding to colors R, G and B, this conversion is represented by, for example, $$\begin{cases} L_R = (1-\alpha)(S_R/255)^\gamma + \alpha, \\ L_G = (1-\alpha)(S_G/255)^\gamma + \alpha, \\ L_B = (1-\alpha)(S_B/255)^\gamma + \alpha, \end{cases} \quad (1)$$

where $S_R$, $S_G$ and $S_B$ are image signal values corresponding to R, G and B, respectively, and $\gamma$ and $\alpha$ may be any real number. In general, however, $\alpha$=0.0 and $\gamma$=2.2 are used when conducting this conversion most simply. As for the conversion, calculation may be conducted directly by using multipliers or calculation may be conducted by using a look-up table.

The RGB maximum luminance calculation unit 204 finds a maximum value of relative luminance corresponding to each of R, G and B in each pixel and outputs the maximum value. The relative luminance calculated by the RGB maximum luminance calculation unit 204 is referred to as RGB maximum luminance.

The region maximum luminance calculation unit 206 calculates a maximum value of RGB maximum luminance in each region of the liquid crystal panel 16 corresponding to each partial region 124 of the back light 12. In the region maximum luminance calculation unit 206, the range in which the maximum relative luminance for each region may be a region corresponding to each partial region 124 of the back light 12, or may be a region which is larger than the above-described region or a region which is smaller than the above-described region.

The luminance calculation unit 2 outputs the maximum relative luminance in each region calculated by the region maximum luminance calculation unit 206 as the luminance setting value of the back light 12. It is possible to ensure display with the maximum luminance supposed by the input image signal with respect to a view actually observed by an observer by calculating the maximum value of the RGB maximum luminance in a region corresponding to each partial region of the back light 12 and handling the maximum value as the setting value of luminance of the back light 12.

Luminance Distribution Calculation Unit

The luminance distribution calculation unit 6 calculates a predicted value of luminance distribution of light incident on the liquid crystal panel 16 actually from the back light 12 when the back light 12 is lit with the modified luminance setting value, from the luminance setting value of the back light 12 modified in the luminance modification unit 4.

Figure 5:
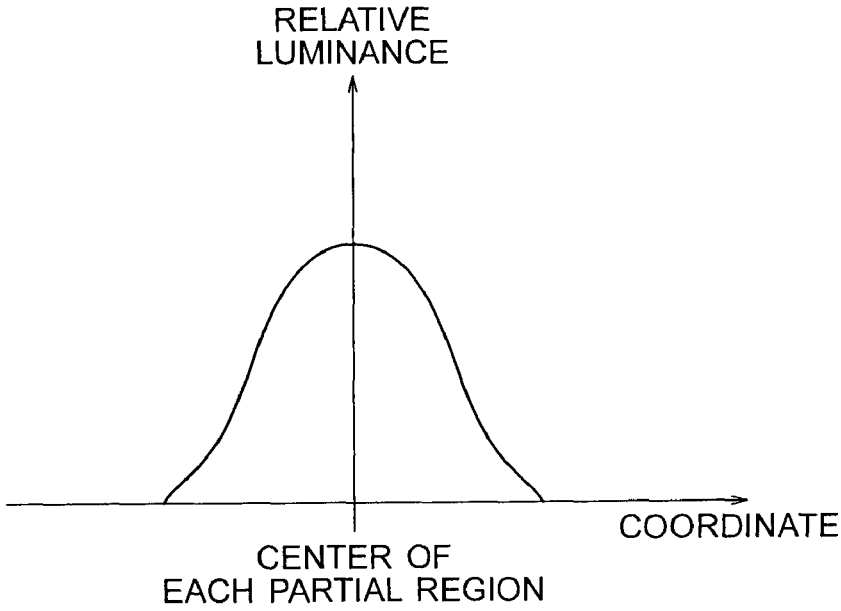
FIG. 5 is a diagram showing an example of luminance distribution in a partial region in the first embodiment.

Since each partial region 124 of the back light 12 has luminous distribution corresponding to the actual hardware configuration, the intensity of light incident on the liquid crystal panel 16 also has distribution corresponding thereto. Here, the intensity of light incident on the liquid crystal panel 16 is expressed simply as luminance of the back light 12 or the partial region 124. An example of luminance distribution of the partial region 124 is shown in FIG. 5. As shown in FIG. 5, the luminance distribution is symmetrical around the center of each partial region. In the distribution, the relative luminance decreases as the location goes away from the center of the partial region. The relative luminance at each coordinate obtained when the nth partial region n is lit with a luminance setting value $L_{set,n}$ can be expressed as $$L_{BL}(x'_n, y'_n) = L_{set,n} \cdot L_{p,n}(x'_n, y'_n) \quad (2)$$

by using this luminance distribution. In Equation (2), $x'_n$ and $y'_n$ are relative coordinates of a point from the center of a partial region n, and $L_{p,n}$ is luminance distribution of the partial region n at that point.

Luminance distribution of the back light 12 at each pixel obtained when each partial region 124 of the back light 12 is lit with a relative luminance $L_{set,n}$ is calculated as a sum of values each obtained by multiplying luminance distribution of each partial region 124 by the luminance setting value of the partial region 124.

Figure 6:
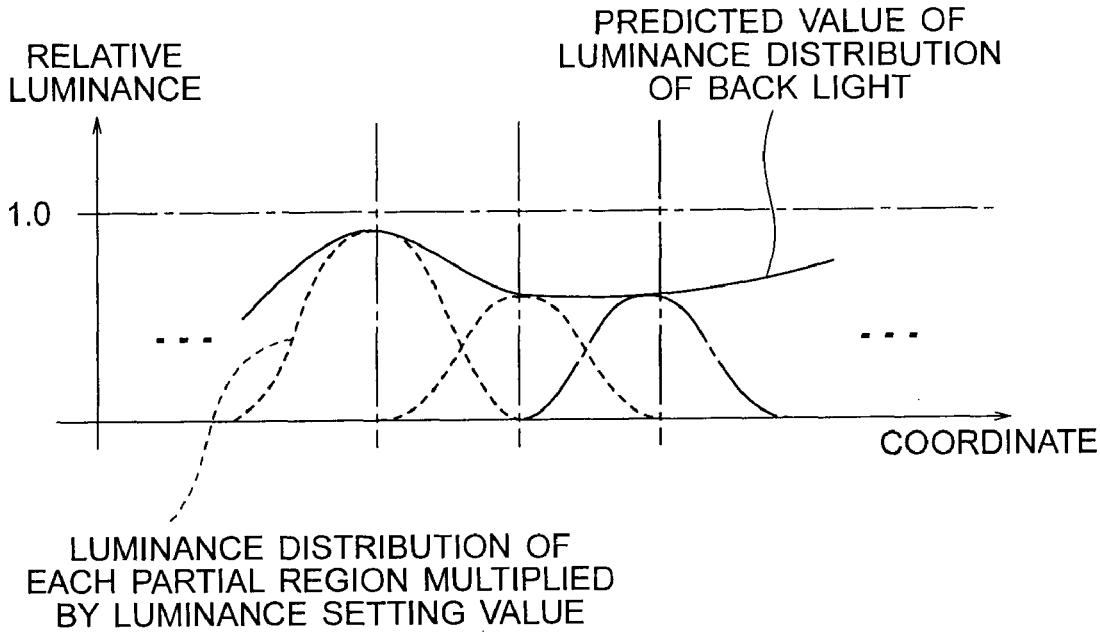
FIG. 6 is a diagram for explaining a method for calculating a predicted value of back light luminance distribution in a luminance distribution calculation unit in the first embodiment.

A method for calculating a predicted value of luminance distribution of the back light 12 is schematically shown in FIG. 6. In other words, the luminance distribution of the back light 12 is calculated according to the following Equation (3) by using the luminance profile $L_{p,n}$ of each partial region:

$$L_{BL}(x, y) = \sum_{n=1}^{N} \{L_{set,n} \cdot L_{p,n}(x - x_{0,n}, y - y_{0,n})\} \quad (3)$$

In Equation (3), x and y are coordinates of a pixel on the liquid crystal panel 16, and $x_{0,n}$ and $y_{0,n}$ are coordinates of the center of the partial region n on the liquid crystal panel 16. N is the total number of partial regions. It is defined in Equation (3) to use luminance setting values and luminance distribution of all partial regions in finding back light luminance distribution at a certain pixel. However, luminance setting values and luminance distribution of partial regions which exercises little influence on the luminance at that pixel can be omitted in calculation of luminance distribution of the back light 12.

The luminance distribution of each partial region used in calculation of luminance distribution of the back light 12 may be calculated directly by approximating the luminance distribution with a suitable function or may be calculated by using a look-up table prepared beforehand.

Liquid Crystal Transmittance Correction Unit

Figure 7:
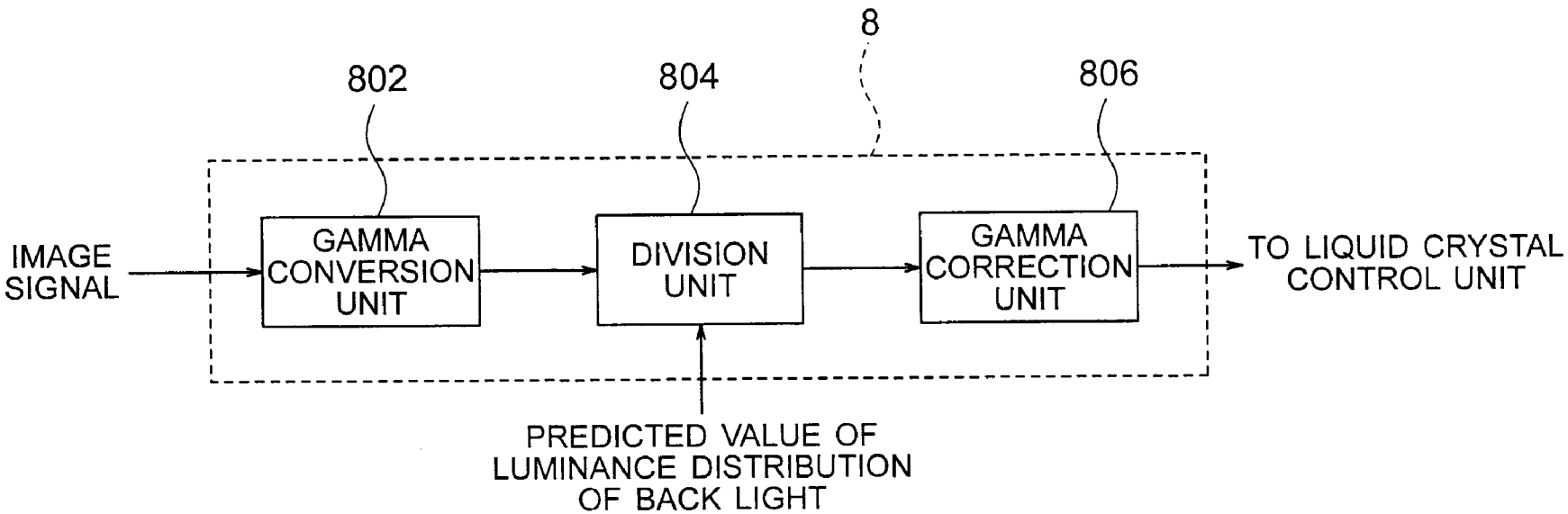
FIG. 7 is a liquid crystal transmittance correction unit in the first embodiment.

The liquid crystal transmittance correction unit 8 corrects transmittance of an image signal at each pixel of the liquid crystal panel 16 on the basis of the luminance distribution predicted value of the back light 12 calculated by the luminance distribution calculation unit 6 and the image signal, and outputs an image signal having the corrected transmittance to the liquid crystal control unit 14. A configuration of a concrete example of the liquid crystal transmittance correction unit 8 is shown in FIG. 7.

The liquid crystal transmittance correction unit 8 includes a gamma conversion unit 802, a division unit 804, and a gamma correction unit 806. The gamma conversion unit 802 has the same configuration as that of the gamma conversion unit 202 in the luminance calculation unit 2 and conducts the same operation as the gamma conversion unit 202 in the luminance calculation unit 2 does. However, the value calculated by the gamma conversion unit 802 in the liquid crystal transmittance correction unit 8 is referred to as optical transmittance instead of relative luminance in the luminance calculation unit 2. The gamma conversion unit 802 in the liquid crystal transmittance correction unit 8 and the gamma conversion unit 202 in the luminance calculation unit 2 can also be constituted as one component.

The gamma conversion unit 802 converts the input image signal values to optical transmittance values of R, G and B. In other words, the gamma conversion unit 802 conducts conversion expressed by Equation (1). Values of $\gamma$ and $\alpha$ in the gamma conversion unit 802 may be the same as $\gamma$ and $\alpha$ in the gamma conversion unit 202 in the luminance calculation unit 2 or may be different from them.

The division unit 804 divides the optical transmittances of R, G and B at each pixel calculated by the gamma conversion unit 802 by the predicted value of the luminance distribution of the back light at each pixel calculated by the luminance distribution calculation unit 6.

The gamma correction unit 806 conducts gamma correction on the post-correction optical transmittance calculated in the division unit 804 to convert it to an image signal to be output to the liquid crystal control unit 14. Supposing that the image signal values which are output are signal values in the range of [0, 255] respectively corresponding to R, G and B, the gamma conversion is conducted by using, for example, the following Equation (4):

$$\begin{cases} S'_R = 255 \times \{(T'_R - \alpha)/(1-\alpha)\}^{-\gamma}, \\ S'_G = 255 \times \{(T'_G - \alpha)/(1-\alpha)\}^{-\gamma}, \\ S'_B = 255 \times \{(T'_B - \alpha)/(1-\alpha)\}^{-\gamma}, \end{cases} \tag{4}$$

Here, $T'_R$, $T'_G$ and $T'_B$ are post-correction optical transmittances corresponding to colors R, G and B, respectively, and $S'_R$, $S'_G$ and $S'_B$ are output image signal values corresponding to R, G and B, respectively. Although $\gamma$ and $\alpha$ may be any real number, it is possible to reproduce an image faithfully to the input signal by setting $\gamma$ equal to the gamma value of the liquid crystal panel 16 and $\alpha$ to the minimum optical transmittance of the liquid crystal panel 16. The gamma correction is not restricted to this conversion, but a known conversion system may be used instead as occasion demands, or inverse conversion according to a gamma conversion table in the liquid crystal panel 16 may be conducted. As for the conversion, calculation may be conducted directly by using multipliers or calculation may be conducted by using a look-up table.

Figure 8A:
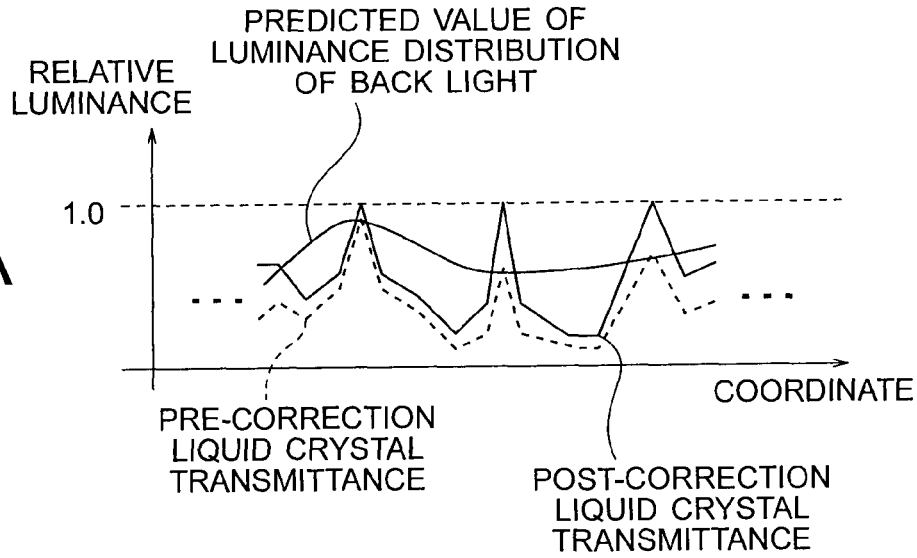
FIGS. 8A and 8B are diagrams for explaining operation of the liquid crystal transmittance correction unit in the first embodiment.
Figure 8B:
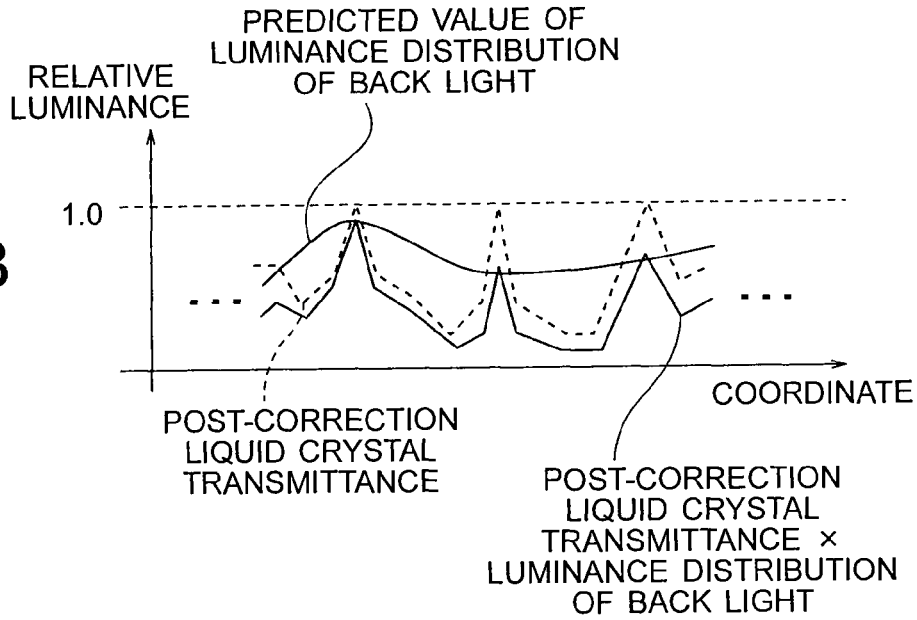

Effects brought about by the operation of the liquid crystal transmittance correction unit 8 will now be described with reference to FIGS. 8A and 8B. As for pre-correction optical transmittance, it is supposed that the relative luminance of the back light 12 is constant over the entire screen. If the luminance of the back light 12 is changed without correcting the optical transmittance of liquid crystal, therefore, the actual display becomes largely different from a display assumed under the input image signal. Therefore, the liquid crystal transmittance correction unit 8 corrects the optical transmittance of liquid crystal by using the luminous distribution of the back light 12 calculated in the luminous distribution calculation unit 6. In the liquid crystal transmittance correction unit 8, the pre-correction optical transmittance is divided by the predicted value of the luminous distribution of the back light 12 at each pixel calculated by the luminous distribution calculation unit 6. At a pixel having a relative luminance of the back light 12 smaller than the maximum luminance, therefore, the post-correction optical transmittance is set so as to become conversely greater than the pre-correction optical transmittance as shown in FIG. 8A. And a video image which can be actually exhibited to an observer can be approximated by (luminance of back light)×(optical transmittance of liquid crystal). As shown in FIG. 8B, therefore, relative luminance obtained by multiplying the post-correction optical transmittance by the prediction value of luminance distribution of the back light 12 can be displayed with a display assumed by the input image signal.

Luminance Modification Unit

The luminance modification unit 4 conducts modification on the setting value of luminance of the back light 12 calculated by the luminance calculation unit 2. Operation of the luminance modification unit 4 will now be described with reference to FIGS. 9(*a*) and 9(*b*).

Figure 9:
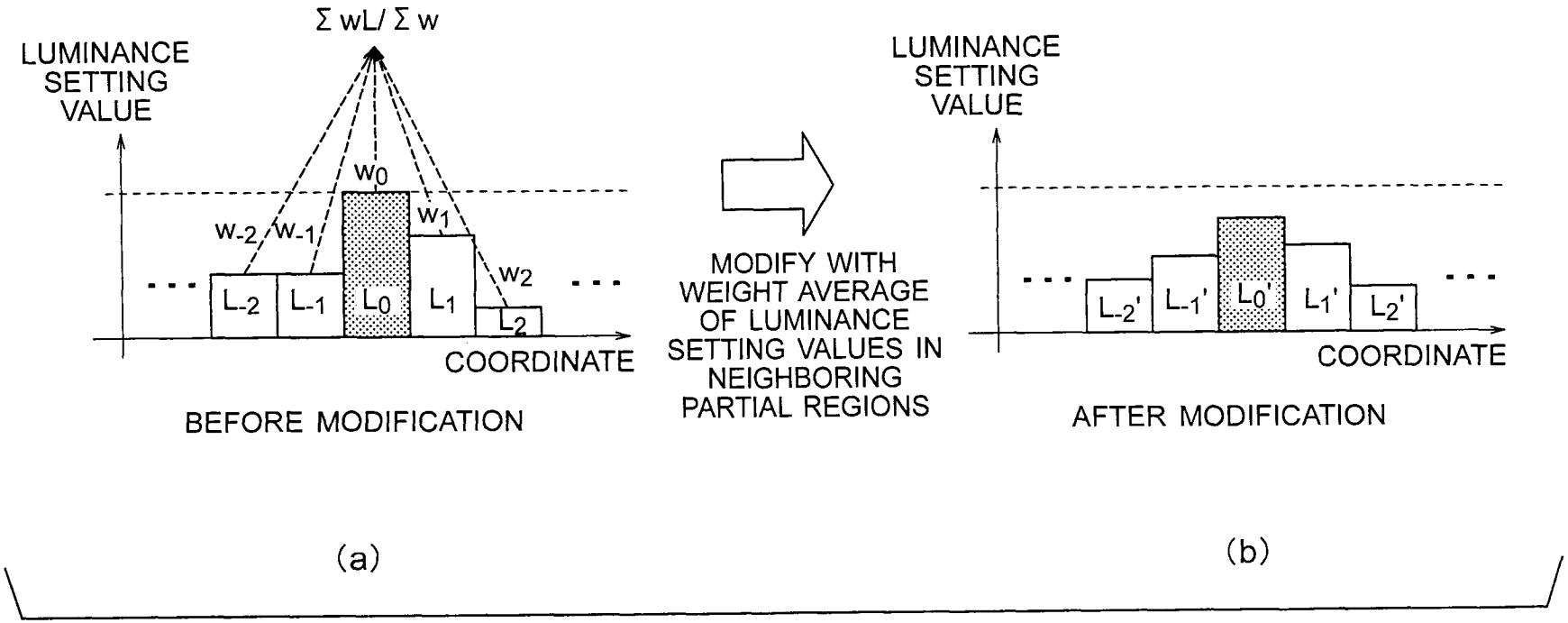
FIGS. 9(*a*) and 9(*b*) are diagrams for explaining operation of a luminance modification unit in the first embodiment.

As shown in FIG. 9(*b*), the luminance modification unit 4 conducts weighted averaging on luminance setting values in neighboring partial regions shown in FIG. 9(*a*) to obtain newly modified luminance setting values. In other words, new luminance setting values in a partial region are calculated from setting values of back light luminance calculated by the luminance calculation unit by using the following Equation (5):

$$L'_{set}(X, Y) = \left[ \sum_{Y'=-R_Y}^{R_Y} \sum_{X'=-R_X}^{R_X} \{w(X', Y') \cdot L_{set}(X + X', Y + Y')\} \right] \Big/ \left[ \sum_{Y'=-R_Y}^{R_Y} \sum_{X'=-R_X}^{R_X} w(X', Y') \right] \tag{5}$$

In Equation (5), X and Y are coordinates of the region, and X' and Y' are relative coordinates of a neighboring partial region. In addition, w(X', Y') is a weight for a luminance setting value in a partial region located at relative coordinates (X', Y'), and $R_X$ and $R_Y$ are radii of a two-dimensional weight table. Here, the two-dimensional weight table is a table having weight data arranged so as to be symmetrical in the longitudinal direction and lateral direction about a region having coordinates X and Y. Therefore, the number of weight data arranged in the longitudinal direction and lateral direction is odd. Supposing that the number of weight data in the longitudinal direction and the number of weight data in the lateral direction are respectively 2k+1 and 2m+1, the radii $R_X$ and $R_Y$ are k and m, respectively. Here, k and m are natural numbers. In the example shown in FIGS. 9(*a*) and 9(*b*), calculation of the weighted average is one-dimensional. However, this is used to make the description easier to understand. As a matter of fact, the calculation of the weighted average is two-dimensional as in Equation (5).

As appreciated from FIGS. 9(*a*) and 9(*b*) as well, the absolute value of the difference in luminance setting value between adjacent partial regions is made small by using a weighted average of luminance setting values in neighboring partial regions as a newly modified luminance setting value. As a result, the back light luminance difference between adjacent partial regions can be made small.

The weighted averaging in the luminance modification unit 4 may be conducted on the setting values of the relative luminance as described in the present embodiment, may be conducted on values obtained by conducting logarithmic conversion on the setting values of relative luminance, or may be conducted on values obtained by conducting other similar conversion.

Liquid Crystal Panel and Liquid Crystal Control Unit

Figure 10:
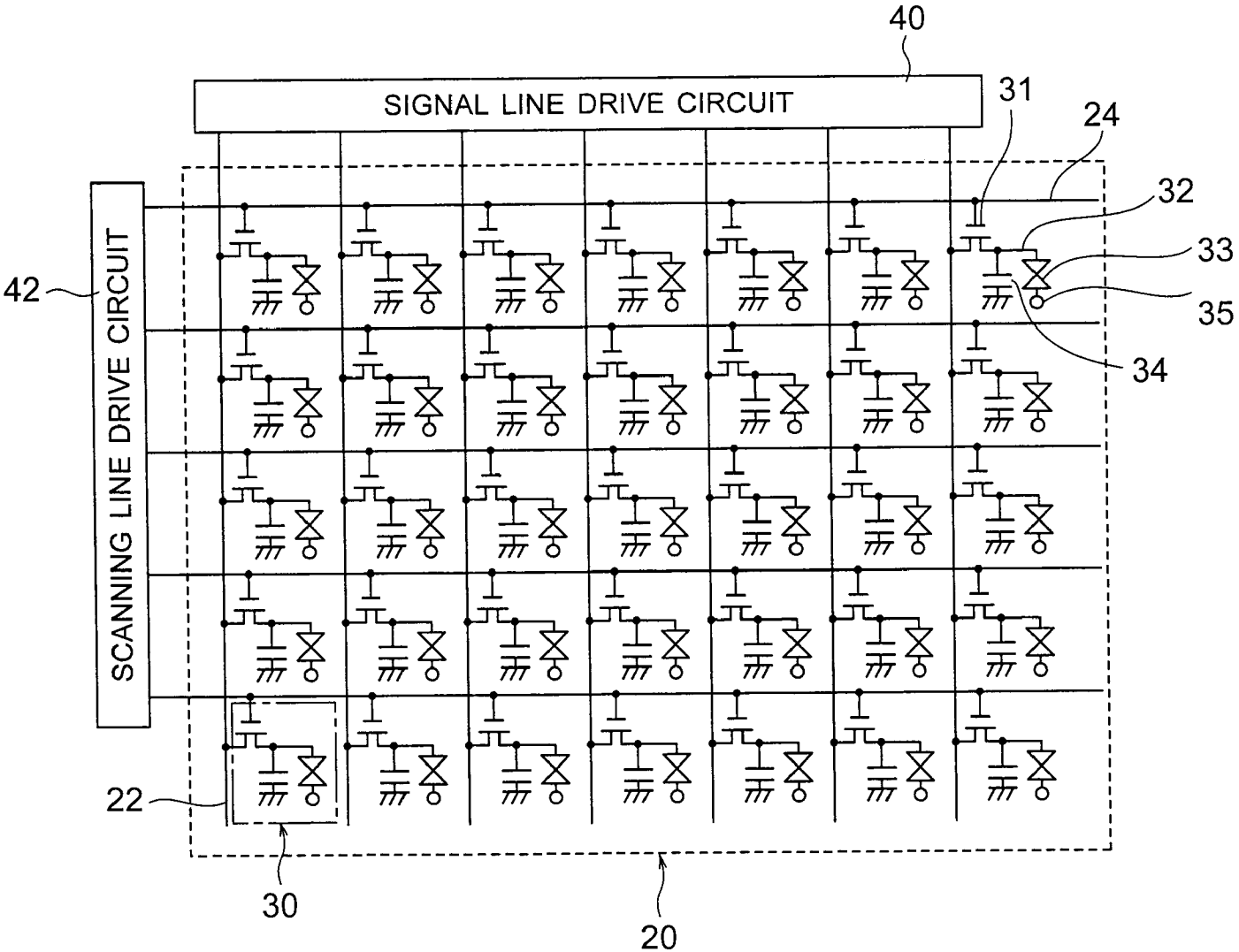
FIG. 10 is a diagram showing a liquid crystal control unit and a liquid crystal panel in the first embodiment.

The liquid crystal panel 16 is active matrix type in the present embodiment. As shown in FIG. 10, a plurality of signal lines 22 and a plurality of scanning lines 24 which cross the signal lines are disposed on an array substrate 20 via an insulation film which is not illustrated. A pixel 30 is formed in each of crossing regions of the signal lines and the scanning lines. Ends of the signal lines 22 are connected to a signal line drive circuit 40, whereas ends of the scanning lines 24 are connected to a scanning line drive circuit 42. Each pixel 30 includes a switch element 31 formed of a thin film transistor (TFT), a pixel electrode 32, a liquid crystal layer 33, an auxiliary capacitance 34, and an opposite electrode 35. By the way, the opposite electrode 35 serves as an electrode common to all pixels 30.

The switch element 31 is a switch element for video signal writing. Gates of the switch elements 31 belonging to one horizontal line are connected in common to a scanning line 24, and sources of the switch elements 31 belonging to one vertical line are connected in common to a signal line 22. In addition, each switch element 31 is connected at its drain to a corresponding pixel electrode 32 and connected to an auxiliary capacitance 34 electrically disposed in parallel to the pixel electrode 32.

The pixel electrode 32 is formed on the array substrate 20. The opposite electrode 35 electrically opposed to the pixel electrode 32 is formed on an opposite substrate which is not illustrated. A predetermined opposite voltage is given to the opposite electrode 35 from an opposite voltage generation circuit which is not illustrated. The liquid crystal layer 33 is held between the pixel electrode and the opposite electrode, and surroundings of the array substrate 20 and the opposite substrate are sealed by using a seal material which is not illustrated. By the way, any material may be used for the liquid crystal used for the liquid crystal layer 33. For example, however, ferroelectric liquid crystal or liquid crystal of OCB (Optically Compensated Bend) mode is suitable as the liquid crystal material.

The scanning line drive circuit 42 is formed of shift registers, level shifters and buffer circuits which are not illustrated. The scanning line drive circuit 42 outputs a row selection signal to each scanning line 24 on the basis of a vertical start signal or a vertical clock signal output from a display ratio control unit which is not illustrated as a control signal.

The signal line drive circuit 40 is formed of analog switches, shift registers, sample-hold circuits and video buses which are not illustrated. A horizontal start signal and a horizontal clock signal output from the display ratio control unit which is not illustrated as a control signal are input to the signal line drive circuit 40. In addition, an image signal is also input to the signal line drive circuit 40.

The liquid crystal control unit 14 controls the liquid crystal panel so as to achieve the liquid crystal transmittance corrected by the liquid crystal transmittance correction unit 8.

Figure 11:
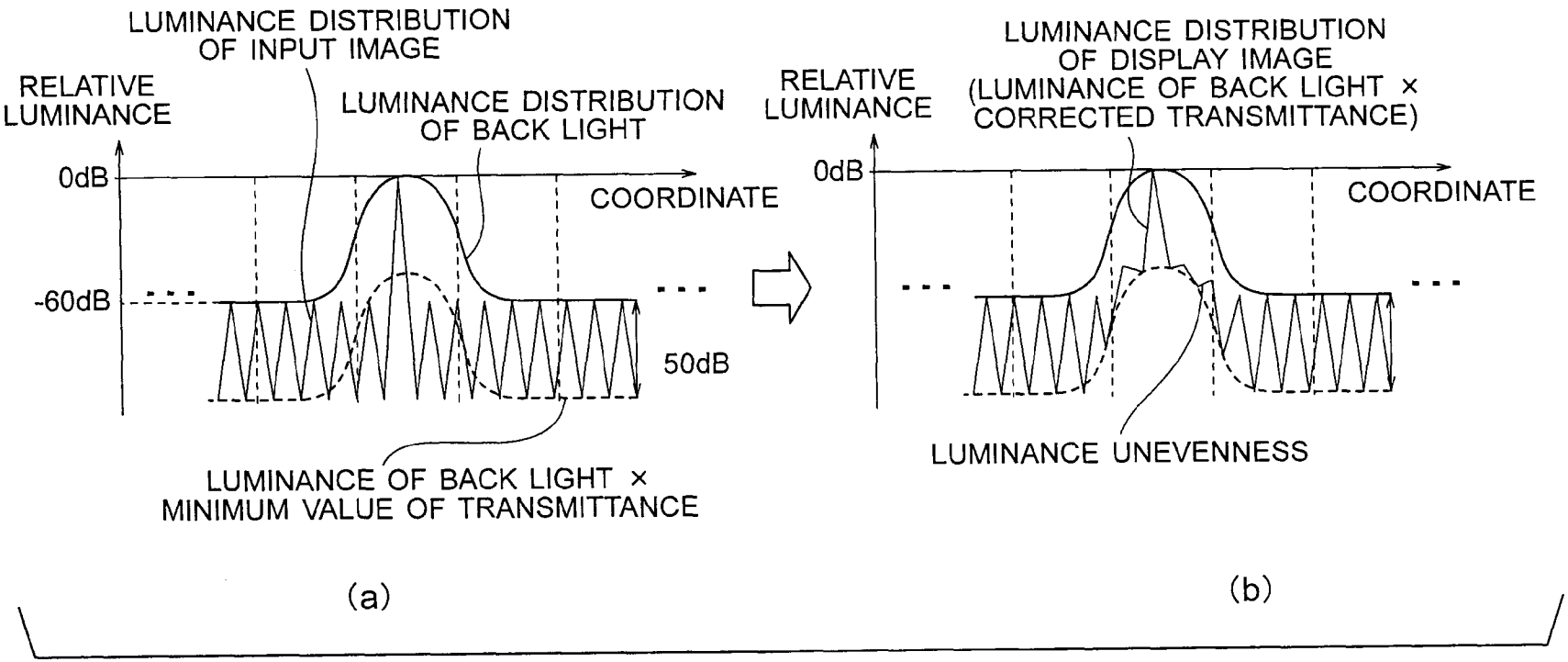
FIGS. 11(*a*) and 11(*b*) are diagrams for explaining occurrence of luminance unevenness.

Effects brought about by the image display apparatus according to the present embodiment will now be described with reference to FIGS. 11(*a*) to 12(*b*).

If the back light luminance difference between adjacent partial regions is great, then unevenness occurs in the display image.

This will now be described with reference to FIGS. 11(*a*) and 11(*b*). It is assumed that transmittance which can be implemented in the liquid crystal is in the range of 0.002 to 1.0 (−50 dB to 0 dB) and an image which expresses a light source having a relative luminance of 1.0 (0 dB) on a dark background having relative luminance which distributes in the range of 0.000002 to 0.001 (−110 dB to −60 dB) is to be displayed as shown in FIG. 11(*a*). In this case, since it is necessary to display a relative luminance of 1.0 in a partial region which expresses the light source (a central partial region in FIG. 11(*a*)), it is desirable to set the relative luminance of the back light equal to 1.0. Therefore, the relative luminance which can be represented by this partial region is in the range of 0.002 to 1.0 (−50 dB to 0 dB) obtained by multiplying the relative luminance of the back light by the transmittance of the liquid crystal. On the other hand, in partial regions which do not express the light source (left and right regions in FIG. 11(*a*)), it is desirable to set the relative luminance of the back light equal to 0.001 in order to make it possible to sufficiently represent the relative luminance in the range of 0.000002 to 0.001. Therefore, the relative luminance which can be represented in this partial region is in the range of 0.000002 to 0.001 (−110 dB to −60 dB) obtained by multiplying the relative luminance of the back light by the transmittance of the liquid crystal. As a result, a dark background in each of the left and right regions can be displayed while remaining dark, as appreciated from FIG. 11(*b*) as well. Since the background part in the central region cannot be displayed, however, it can be displayed only in a slightly brightened state. If such a display is conducted, the background in the central partial region is perceived as if it floats whitely as compared with the backgrounds in the left and right partial regions. The luminance gradient at both ends of the partial regions is perceived as unevenness. If the back light luminance difference between adjacent partial regions is thus great, unevenness occurs in the display image.

Figure 12:
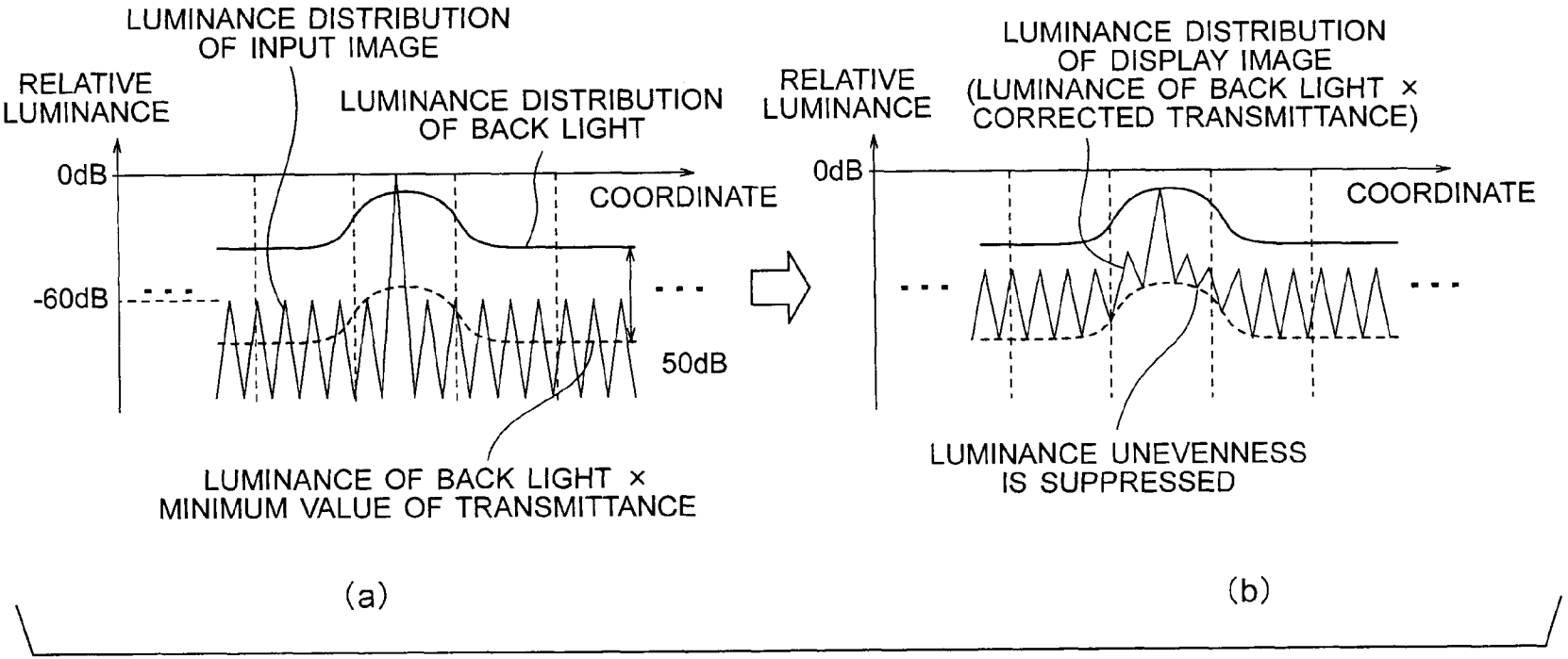
FIGS. 12(*a*) and 12(*b*) are diagrams for explaining suppression of luminance unevenness in an image display apparatus in the first embodiment.

The fact that the luminance unevenness is suppressed by making the luminance difference between adjacent partial regions as in the present embodiment will now be described with reference to FIGS. 12(*a*) and 12(*b*). FIGS. 12(*a*) and 12(*b*) show a display image obtained when the luminance difference between adjacent partial regions is made small as compared with FIGS. 11(*a*) and 11(*b*). It is appreciated that the luminance gradient at both ends of the central partial region is reduced in FIGS. 12(*a*) and 12(*b*) as compared with FIGS. 11(*a*) and 11(*b*). Since vision of a human being has a property that a luminance gradient which is equal to a certain value or less is not recognized, it is not always necessary to get rid of the luminance gradient completely. Although the display luminance of the dark background is brighter in FIG. 12(*b*) as compared with FIG. 11(*b*), the dynamic range expanding effect and the power dissipation reducing effect are sufficient as compared with the case where the back light luminance control is not conducted.

Thus, the image display apparatus according to the present embodiment enables image display with a wider dynamic range and lower power dissipation and is capable of reducing the luminance difference between adjacent partial regions and suppressing luminance unevenness caused by the luminance difference.

Second Embodiment

An image display apparatus according to a second embodiment will now be described.

Although the image display apparatus according to the present embodiment is the same in basic configuration as the image display apparatus according to the first embodiment shown in FIG. 1, the image display apparatus according to the present embodiment is different from the display apparatus according to the first embodiment in the configuration of the luminance modification unit 4.

Luminance Modification Unit

The luminance modification unit 4 according to the second embodiment calculates a difference value between a luminance setting value of back light 12 of a pertinent partial region and a luminance setting value of the back light 12 in a partial region neighboring the pertinent partial region, calculates a weight so as to make a weight for a neighboring partial region larger as the difference value for the neighboring partial region is greater, calculates a weighted average of luminance setting values of neighboring partial regions by using weights thus calculated, and calculates a new luminance setting value in the pertinent partial region.

Roughly speaking, the calculation of the modified luminance setting value using the weighted average of luminance setting values for neighboring partial regions is conducted in the same way as the first embodiment as shown in FIGS. 9(*a*) and 9(*b*). Since the weight w changes depending upon luminance setting values at that coordinate, however, numerical values are calculated by using the following Equation (6):

$$L'_{set}(X, Y) = \frac{\sum_{Y'=-R_Y}^{R_Y} \sum_{X'=-R_X}^{R_X} \left\{ \begin{matrix} w(L_{set}(X+X', Y+Y') - L_{set}(X, Y)) \cdot \\ L_{set}(X+X', Y+Y') \end{matrix} \right\}}{\sum_{Y'=-R_Y}^{R_Y} \sum_{X'=-R_X}^{R_X} w(L_{set}(X+X', Y+Y') - L_{set}(X, Y))} \quad (6)$$

In Equation (6), X an Y are coordinates of the pertinent partial region, and X' an Y' are relative coordinates in a partial region neighboring the pertinent partial region. w is a weight for a luminance setting value in a partial region having relative coordinates (X', Y'). $R_X$ and $R_Y$ are radii of a weight table.

In the luminance modification unit according to the second embodiment, the weight w is calculated from back light luminance setting values of partial regions neighboring the pertinent partial region so as to make a weight for a neighboring partial region larger as the difference value of the back light luminance setting value in the pertinent partial region for the neighboring partial region is greater.

Figure 13:
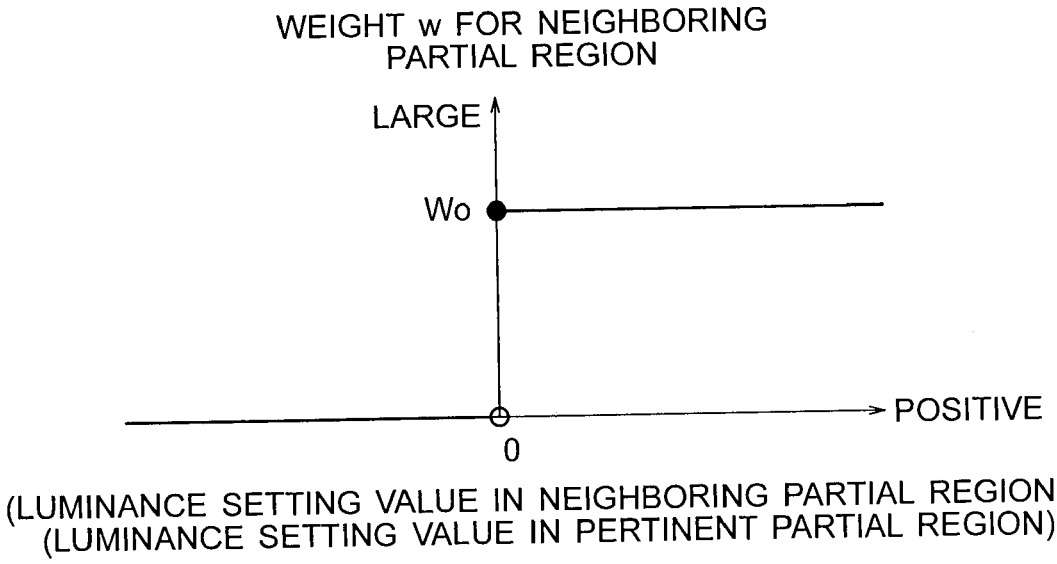
FIG. 13 is a diagram showing an example of relations between a difference value of a luminance setting value and a weight in a second embodiment.
Figure 14:
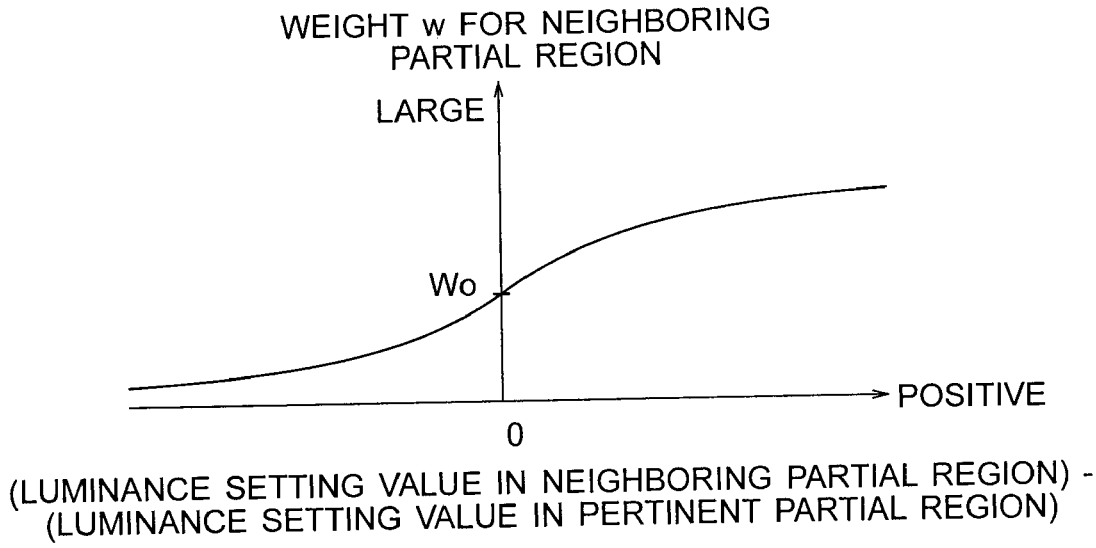
FIG. 14 is a diagram showing an example of relations between a difference value of a luminance setting value and a weight in a second embodiment.

The weight w is calculated from the difference value of the luminance setting value as shown in, for example, FIG. 13 or FIG. 14. In FIG. 13, the weight w is set equal to "0", when the difference in luminance setting value between a partial region neighboring the pertinent partial region and the pertinent partial region is negative. The weight w is set equal to a certain positive definite value $w_0$, when the difference is positive. When the difference is "0", the weight w may be the positive definite value $w_0$, or may be a value which is less than or greater than the definite value $w_0$. FIG. 14 shows a property that the weight w increases monotonously as the difference increases. In FIG. 14, the weight w has a value $w_0$ when the difference is "0." Alternatively, the weight w may be a value which is less than the value $w_0$, or a value which is greater than the value $w_0$. As appreciated from FIGS. 13 and 14, a greater weight is used as the difference in luminance setting value between the pertinent partial region and a neighboring partial region is greater. Here, the weight w can be found by computation from the difference value of luminance setting value, or the weight w can be found by using a look-up table.

Effects brought about by the luminance modification unit 4 according to the second embodiment will now be described.

The effects brought about by the luminance modification unit 4 according to the second embodiment will be described with reference to FIGS. 15(*a*) to 16(*b*).

Figure 15:
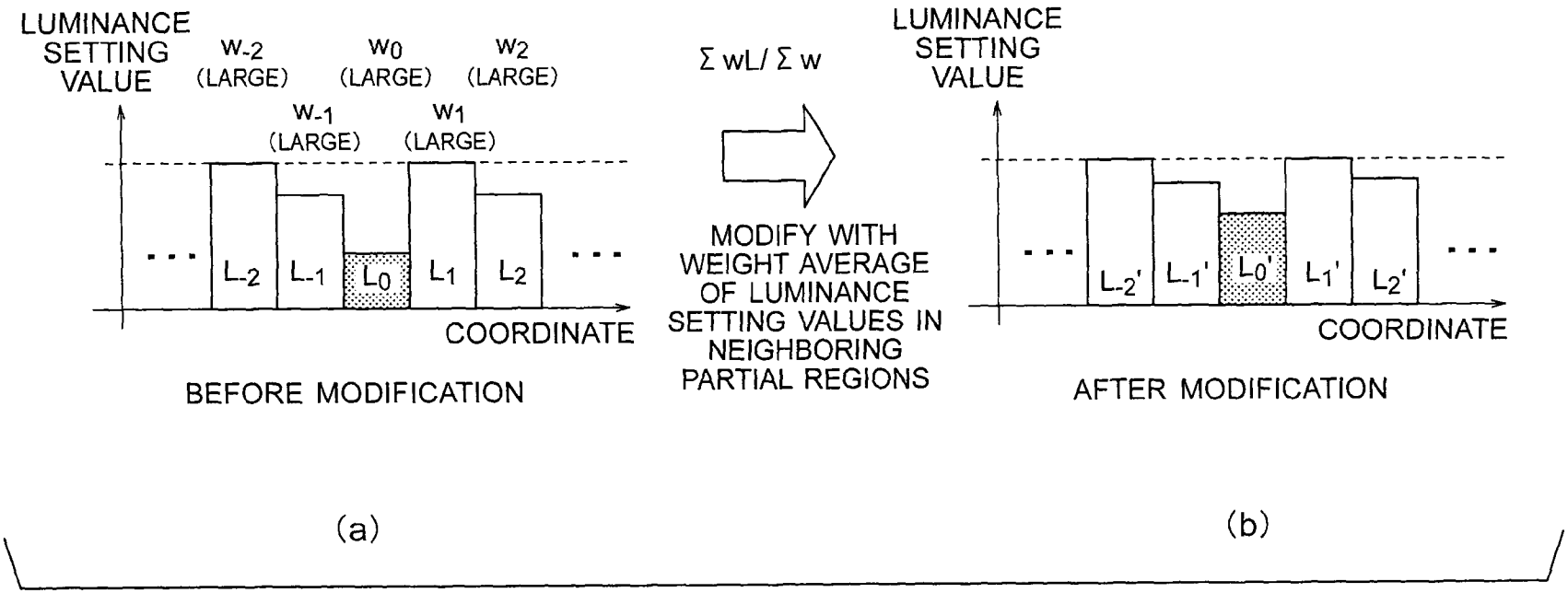
FIGS. 15(*a*) and 15(*b*) are diagrams for explaining operation of a luminance modification unit in the second embodiment.

FIGS. 15(*a*) and 15(*b*) is a diagram for explaining the operation of the luminance modification unit 4 when the neighboring partial region is greater in luminance setting value than the pertinent partial region in the second embodiment. If luminance setting values $L_{-2}$, $L_{-1}$, $L_1$ and $L_2$ in neighboring partial regions are greater than a luminance setting value $L_0$ in the pertinent partial region which is an object of a luminance setting value to be modified as shown in FIG. 15(*a*), the difference (=(luminance setting value in a neighboring partial region)−(luminance setting value in the pertinent partial region)) assumes a great value for any neighboring partial region. Therefore, the weight for a neighboring partial region becomes great for any neighboring partial region. As a result of conducting weighted averaging by using such a weight, a modified luminance setting value $L_0'$ in the pertinent partial region becomes a value greater than the original luminance setting value $L_0$ as shown in FIG. 15(*b*).

Figure 16:
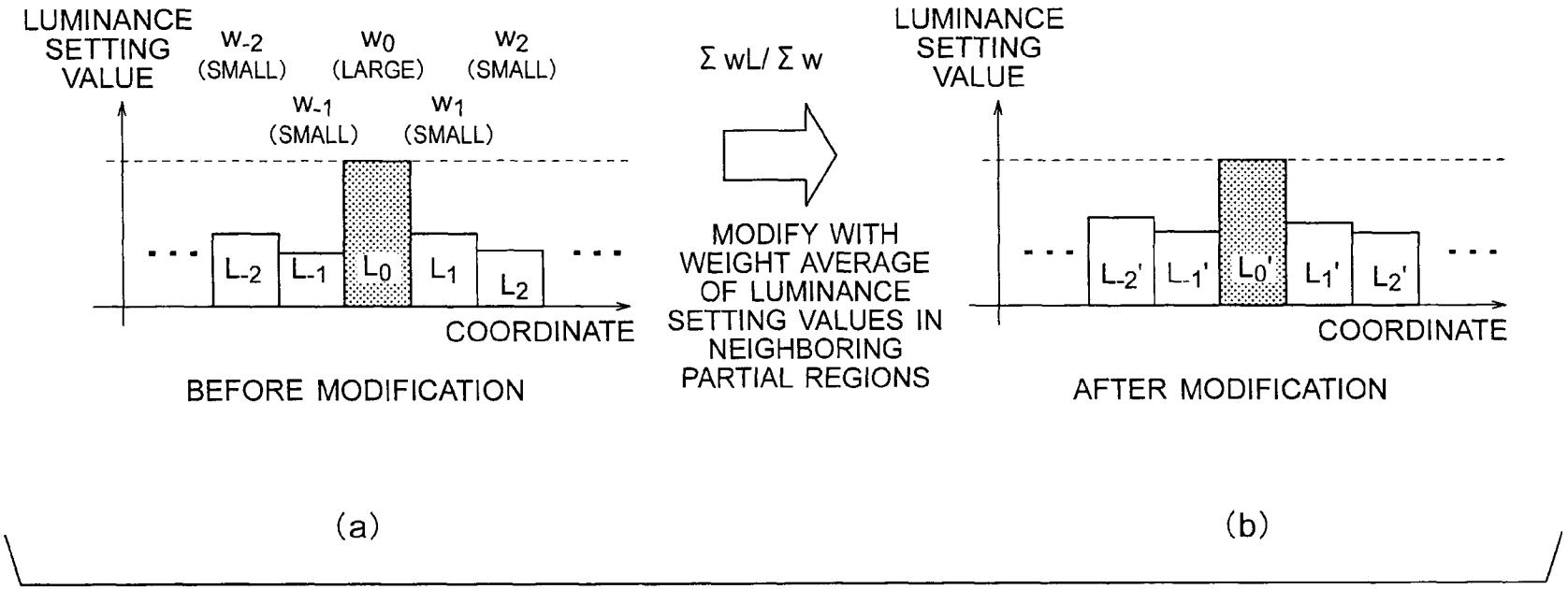
FIGS. 16(*a*) and 16(*b*) are diagrams for explaining operation of a luminance modification unit in the second embodiment.

FIGS. 16(*a*) and 16(*b*) is a diagram for explaining the operation of the luminance modification unit 4 obtained when the neighboring partial region is less in luminance setting value than the pertinent partial region in the second embodiment. If luminance setting values $L_{-2}$, $L_{-1}$, $L_1$ and $L_2$ in neighboring partial regions are less than a luminance setting value $L_0$ in the pertinent partial region which is an object of a luminance setting value to be modified as shown in FIG. 16(*a*), the difference (=(luminance setting value in a neighboring partial region)−(luminance setting value in the pertinent partial region)) assumes a small value for any neighboring partial region except the pertinent partial region. Therefore, the weight for a neighboring partial region becomes small for any neighboring partial region except the pertinent partial region. As a result of conducting weighted averaging by using such a weight, a calculated modified luminance setting value $L_0'$ becomes a value less than the original luminance setting value $L_0$ as shown in FIG. 16(*b*). However, its change quantity is small. In particular when the weight is calculated by using the relation shown in FIG. 13, the luminance setting value in the pertinent region which is an object of the modification of the luminance setting value does not change.

Because of the property described heretofore, the processing conducted in the luminance modification unit 4 according to the second embodiment has a property that the luminance setting value is hard to become smaller. In particular, when the weight is calculated by using the relation shown in FIG. 13, the luminance setting value is not made small by the processing conducted in the luminance modification unit 4.

On the other hand, the processing conducted in the luminance modification unit according to the first embodiment has a property that the luminance difference between adjacent partial regions becomes small but the luminance setting value in any partial region approaches the average value. This indicates that there is a possibility that the luminance of the back light 12 is made small by the processing conducted in the luminance modification unit even in a partial region which actually needs great luminance of the back light 12.

On the other hand, the luminance modification unit according to the second embodiment has a property that the luminance setting value of the back light 12 is hard to become small. Therefore, it is possible to make the luminance difference between regions small while maintaining the maximum luminance required for the image display.

Thus, the image display apparatus according to the present embodiment makes it possible to reduce the luminance difference between adjacent partial regions, suppress the luminance unevenness caused by the luminance difference, and conduct image display with a wide dynamic range and low power dissipation while maintaining the maximum luminance required for the image display.

Third Embodiment

An image display apparatus according to a third embodiment will now be described. Although the image display apparatus according to the present embodiment is the same in basic configuration as the image display apparatus according to the first embodiment, the image display apparatus according to the present embodiment is different from the display apparatus according to the first embodiment in the configuration of the luminance modification unit 4.

Luminance Modification Unit

The luminance modification unit 4 according to the present embodiment calculates the luminance setting value in the pertinent partial region so that a luminance gradient in a partial region neighboring the pertinent partial region which is an object of modification of luminance setting value becomes equal to a threshold or less. Operation of the luminance modification unit 4 will now be described with reference to FIGS. 17(*a*) and 17(*b*).

First, from among partial regions neighboring the pertinent partial region which is the object of luminance setting value modification, a partial region having a maximum luminance gradient between itself and the pertinent partial region is searched for. Here, the luminance gradient is {(luminance setting value in neighboring partial region)−(luminance setting value in pertinent partial region which is object of luminance setting value modification)}/(distance between partial regions). In the case shown in FIG. 17(*a*), the partial region having a luminance setting value $L_1$ is a partial region having a maximum luminance gradient, and the maximum luminance gradient is $(L_1-L_0)/1$. Here, the distance between adjacent partial regions is set equal to 1.

Figure 17:
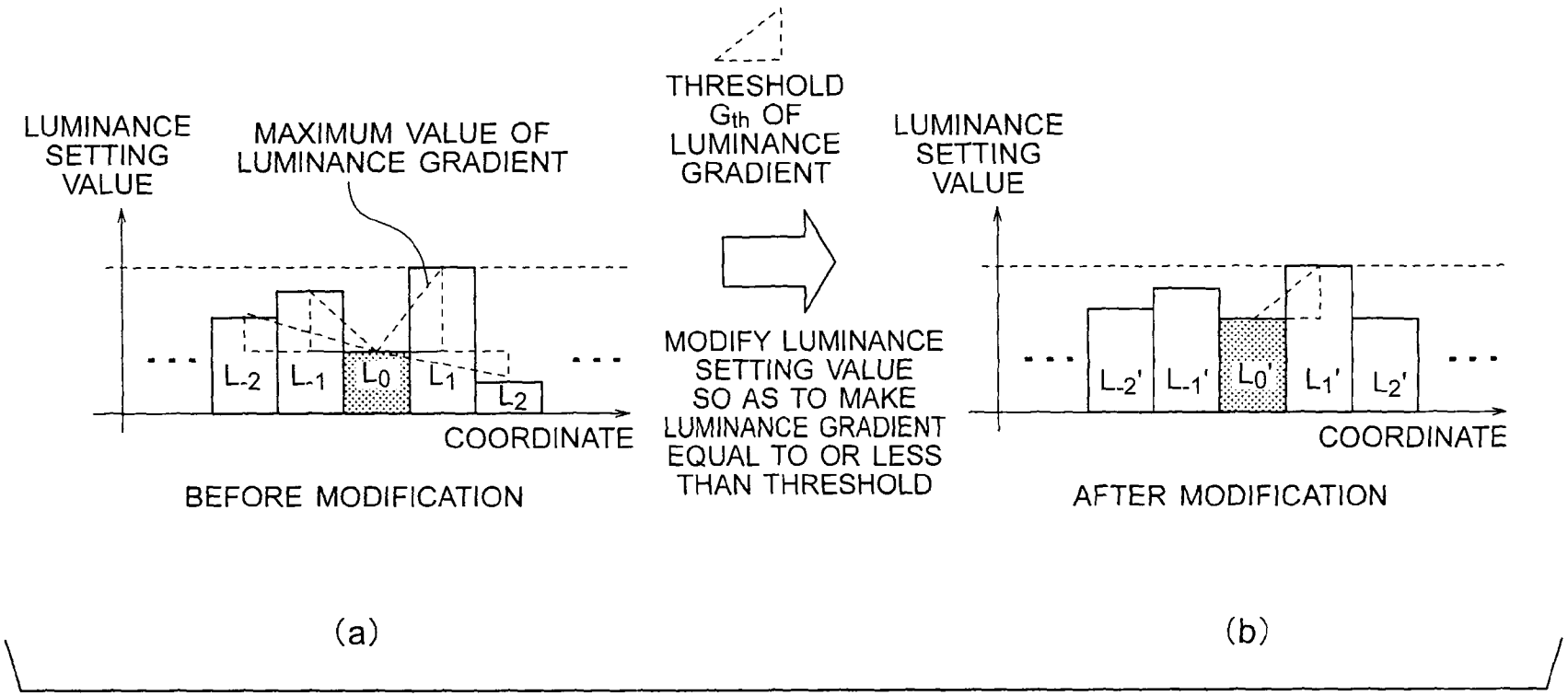
FIGS. 17(*a*) and 17(*b*) are diagrams for explaining operation of a luminance modification unit in a third embodiment.

Subsequently, the luminance setting value in the pertinent partial region is updated so that the luminance gradient between the partial region having the maximum luminance gradient and the pertinent partial region which is the object of luminance setting value modification becomes equal to a threshold or less. If the partial region having a maximum luminance gradient is a partial region having a luminance setting value $L_1$ as shown in FIG. 17(*a*), the luminance setting value is updated from $L_0$ to $L_1-G_{th}\times 1$ as shown in FIG. 17(*b*), where the threshold is $G_{th}$. If the maximum luminance gradient is equal to or less than the threshold, it is not necessary to update the luminance setting value.

By conducting the procedures heretofore described, the luminance setting value is modified so that the luminance gradient between the pertinent partial region which is the object of luminance setting value modification and a neighboring partial region becomes equal to the threshold or less.

Effects brought about by the luminance modification unit according to the present embodiment will now be described.

As appreciated from FIGS. 17(*a*) and 17(*b*) as well, the luminance gradient between partial regions is corrected so as to become equal to or less than the threshold by the processing conducted by the luminance modification unit 4 according to the third embodiment, and the luminance setting value does not become small in any partial region. Thus, the image display apparatus according to the present embodiment makes it possible to reduce the luminance difference between adjacent partial regions, suppress the luminance unevenness caused by the luminance difference, and conduct image display with a wide dynamic range and low power dissipation while maintaining the maximum luminance required for the image display.

According to the embodiments of the present invention, it is possible to suppress luminance unevenness caused by back light luminance difference between adjacent regions as heretofore described.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concepts as defined by the appended claims and their equivalents.

What is claimed is:

1. An image display apparatus comprising:

a liquid crystal panel including a plurality of pixels arranged in a matrix form;

a back light including a luminous region to supply light to the liquid crystal panel, the luminous region being divided into a plurality of partial regions, light adjustment being possible for each of the partial regions;

a luminance calculation unit configured to calculate a luminance setting value of light emitted from each partial region of the back light on the basis of an image signal;

a luminance modification unit configured to modify the luminance setting value so as to make a luminance difference between adjacent partial regions of the back light smaller;

a luminance distribution calculation unit configured to calculate a predicted value of luminance distribution of light incident on the liquid crystal panel from the back light on the basis of the modified luminance setting value;

a liquid crystal transmittance correction unit configured to correct an optical transmittance of the image signal at each pixel of the liquid crystal panel on the basis of the image signal and the luminance distribution;

a back light control unit configured to control the back light on the basis of the modified luminance setting value; and a liquid crystal control unit configured to control the liquid crystal panel so that the transmittance of the image signal becomes the corrected optical transmittance, wherein the luminance modification unit calculates difference values by subtracting a luminance setting value in a first partial region from luminance setting values in second partial regions located near the first partial region of the back light, calculates weights so as to make the weight greater as the difference value is larger, calculates a weighted average value of luminance setting values in the second partial regions by using the calculated weights, and uses the weighted average value as a new luminance setting value in the first partial region.

2. The apparatus according to claim 1, wherein the luminance calculation unit comprises:

a first gamma conversion unit configured to convert the image signal to relative luminance values of R, G and B with respect to each of the pixels;

an RGB maximum luminance calculation unit configured to calculate a maximum relative luminance from among relative luminance values of R, G and B with respect to each of the pixels; and a region maximum luminance calculation unit configured to calculate a maximum value of the maximum relative luminance calculated by the RGB maximum luminance calculation unit, in regions of the liquid crystal panel corresponding to partial regions of the back light.

3. The apparatus according to claim 1, wherein the luminance distribution calculation unit calculates a predicted value of luminance distribution of the back light by summing up products of luminance distribution in each partial region of the back light and a modified luminance setting value in the partial region over all partial regions of the back light.

4. The apparatus according to claim 1, wherein the liquid crystal transmittance correction unit comprises:

a second gamma conversion unit configured to convert the image signal to optical transmittance values of R, G and B with respect to each of the pixels;

a division unit configured divide the optical transmittance values output from the second gamma conversion unit by the calculated predicted value of the luminance distribution to correct the optical transmittance; and a gamma correction unit configured to conduct gamma correction on the corrected optical transmittance and thereby output an image signal corrected in optical transmittance.

5. An image display apparatus comprising:

a liquid crystal panel including a plurality of pixels arranged in a matrix form;

a back light including a luminous region to supply light to the liquid crystal panel, the luminous region being divided into a plurality of partial regions, light adjustment being possible for each of the partial regions;

a luminance calculation unit configured to calculate a luminance setting value of light emitted from each partial region of the back light on the basis of an image signal;

a luminance modification unit configured to modify the luminance setting value so as to make a luminance difference between adjacent partial regions of the back light smaller;

a luminance distribution calculation unit configured to calculate a predicted value of luminance distribution of light incident on the liquid crystal panel from the back light on the basis of the modified luminance setting value;

a liquid crystal transmittance correction unit configured to correct an optical transmittance of the image signal at each pixel of the liquid crystal panel on the basis of the image signal and the luminance distribution;

a back light control unit configured to control the back light on the basis of the modified luminance setting value; and a liquid crystal control unit configured to control the liquid crystal panel so that the transmittance of the image signal becomes the corrected optical transmittance, wherein the luminance modification unit calculates a luminance gradient between luminance setting values in second partial regions located near a first partial region of the back light and a luminance setting value in the first partial region, calculates a luminance setting value in the first partial region so that a luminance gradient between a third partial region among the second partial regions in which the calculated luminance gradient is maximized and the first partial region becomes equal to or less than a threshold, and uses the calculated luminance setting value as a new luminance setting value in the first partial region.

6. The apparatus according to claim 5, wherein the luminance calculation unit comprises:

a first gamma conversion unit configured to convert the image signal to relative luminance values of R, G and B with respect to each of the pixels;

an RGB maximum luminance calculation unit configured to calculate a maximum relative luminance from among relative luminance values of R, G and B with respect to each of the pixels; and a region maximum luminance calculation unit configured to calculate a maximum value of the maximum relative luminance calculated by the RGB maximum luminance calculation unit, in regions of the liquid crystal panel corresponding to partial regions of the back light.

7. The apparatus according to claim 5, wherein the luminance distribution calculation unit calculates a predicted value of luminance distribution of the back light by summing up products of luminance distribution in each partial region of the back light and a modified luminance setting value in the partial region over all partial regions of the back light.

8. The apparatus according to claim 5, wherein the liquid crystal transmittance correction unit comprises:

a second gamma conversion unit configured to convert the image signal to optical transmittance values of R, G and B with respect to each of the pixels;

a division unit configured divide the optical transmittance values output from the second gamma conversion unit by the calculated predicted value of the luminance distribution to correct the optical transmittance; and a gamma correction unit configured to conduct gamma correction on the corrected optical transmittance and thereby output an image signal corrected in optical transmittance.

9. An image display method for an image display apparatus including a liquid crystal panel having a plurality of pixels arranged in a matrix form, and a back light including a luminous region to supply light to the liquid crystal panel, the luminous region being divided into a plurality of partial regions, light adjustment being possible for each of the partial regions, the method comprising:

calculating a luminance setting value of light emitted from each partial region of the back light on the basis of an image signal;

modifying the luminance setting value so as to make a luminance difference between adjacent partial regions of the back light small;

calculating a predicted value of luminance distribution of light incident on the liquid crystal panel from the back light on the basis of the modified luminance setting value;

correcting an optical transmittance of the image signal at each pixel of the liquid crystal panel on the basis of the image signal and the luminance distribution;

controlling the back light on the basis of the modified luminance setting value; and controlling the liquid crystal panel so that the transmittance of the image signal becomes the corrected optical transmittance, wherein the modifying the luminance setting value comprises:

calculating difference values by subtracting a luminance setting value in a first partial region from luminance setting values in second partial regions located near the first partial region of the back light;

calculating weights so as to make the weight greater as the difference value is larger; and calculating a weighted average value of luminance setting values in the second partial regions by using the calculated weights, and using the weighted average value as a new luminance setting value in the first partial region.

10. An image display method for an image display apparatus including a liquid crystal panel having a plurality of pixels arranged in a matrix form, and a back light including a luminous region to supply light to the liquid crystal panel, the luminous region being divided into a plurality of partial regions, light adjustment being possible for each of the partial regions, the method comprising:

calculating a luminance setting value of light emitted from each partial region of the back light on the basis of an image signal;

modifying the luminance setting value so as to make a luminance difference between adjacent partial regions of the back light small;

calculating a predicted value of luminance distribution of light incident on the liquid crystal panel from the back light on the basis of the modified luminance setting value;

correcting an optical transmittance of the image signal at each pixel of the liquid crystal panel on the basis of the image signal and the luminance distribution;

controlling the back light on the basis of the modified luminance setting value; and controlling the liquid crystal panel so that the transmittance of the image signal becomes the corrected optical transmittance, wherein the modifying the luminance setting value comprises:

calculating a luminance gradient between luminance setting values in second partial regions located near a first partial region of the back light and a luminance setting value in the first partial region;

calculating a luminance setting value in the first partial region so that a luminance gradient between a third partial region among the second partial regions in which the calculated luminance gradient is maximized and the first partial region becomes equal to or less than a threshold, and using the calculated luminance setting value as a new luminance setting value in the first partial region.

* * * * *